US006122460A

United States Patent [19]

Meece et al.

[11] Patent Number: 6,122,460

[45] Date of Patent: Sep. 19, 2000

[54] METHOD AND APPARATUS FOR AUTOMATICALLY COMPENSATING A DEGRADATION OF THE CHARGE ROLLER VOLTAGE IN A LASER PRINTER

[75] Inventors: Kermit Arnold Meece; Christopher David Strack; Troy Dustin Smith Tomson, all of Lexington, Ky.

[73] Assignee: Lexmark International, Inc., Lexington, Ky.

[21] Appl. No.: 09/453,017

[22] Filed: Dec. 2, 1999

[51] Int. Cl.[7] ..... G03G 15/00; G03G 15/02

[52] U.S. Cl. ..... 399/31; 399/43; 399/50; 399/176

[58] Field of Search ..... 399/31, 43, 50, 399/176

[56] References Cited

U.S. PATENT DOCUMENTS

| | | | |
|---|---|---|---|
| 4,105,321 | 8/1978 | Urso . | |
| 4,417,804 | 11/1983 | Werner, Jr. . | |
| 4,542,981 | 9/1985 | Anzai et al. . | |
| 5,164,776 | 11/1992 | Oresick et al. . | |
| 5,173,734 | 12/1992 | Shimizu et al. . | |
| 5,383,005 | 1/1995 | Thompson et al. . | |
| 5,499,078 | 3/1996 | Kurokawa et al. | 399/31 |
| 5,499,080 | 3/1996 | Furuya et al. . | |
| 5,523,831 | 6/1996 | Rushing . | |
| 5,568,231 | 10/1996 | Asano et al. . | |
| 5,572,295 | 11/1996 | Sakagami et al. . | |
| 5,602,628 | 2/1997 | Sugiyama et al. . | |
| 5,659,839 | 8/1997 | Mizude et al. . | |
| 5,737,663 | 4/1998 | Handa et al. . | |
| 5,742,868 | 4/1998 | Rushing . | |
| 5,749,019 | 5/1998 | Mestha . | |
| 5,768,653 | 6/1998 | Fare'. | |
| 5,805,954 | 9/1998 | Takahashi . | |
| 5,805,956 | 9/1998 | Kawai et al. . | |
| 5,812,905 | 9/1998 | Yoo . | |
| 5,842,081 | 11/1998 | Kaname et al. . | |
| 5,845,172 | 12/1998 | Saito et al. . | |

FOREIGN PATENT DOCUMENTS

| | | |
|---|---|---|
| 5-27557 | 2/1993 | Japan . |
| 7-175295 | 7/1995 | Japan . |
| 8-160680 | 6/1996 | Japan . |
| 9-120198 | 5/1997 | Japan . |

*Primary Examiner*—Joan Pendegrass
*Attorney, Agent, or Firm*—John A. Brady

[57] ABSTRACT

An improved electrophotographic printer is provided in which the voltage applied to the charge roller is automatically adjusted to compensate for its changing characteristics over its life span. A high voltage DC power supply includes an output that is connected to the charge roller, and the input side of this high voltage DC power supply is controlled by a microprocessor of the print engine. The print engine controls the output voltage of the high voltage DC power supply by changing the duty cycle of the pulse-width modulated control signal that is supplied to the input of the high voltage DC power supply. A look-up table contains the correct duty cycle for the pulse-width modulated control signal with respect to the number of prints that have been made. The result of the inspection of the look-up table is used by the microprocessor of the print engine to control the correct duty cycle for the pulse-width modulated signal. Over time, the charge roller characteristics begin to change, and after a predetermined number of prints have been made, the pulse-width modulated control signal has its duty cycle increased by a value that is provided in the look-up table. This increase in the duty cycle is performed several times over the operating life of the charge roller, in order to maintain the effective voltage applied to the photoconductive drum to a nominal value.

19 Claims, 7 Drawing Sheets

METHOD AND APPARATUS FOR AUTOMATICALLY COMPENSATING A DEGRADATION OF THE CHARGE ROLLER VOLTAGE IN A LASER PRINTER

TECHNICAL FIELD

The present invention relates generally to image forming equipment and is particularly directed to a laser printer of the type which includes a photoconductive drum and a charge roller. The invention is specifically disclosed as a laser printer that periodically increases its charge roller voltage to automatically compensate for contamination or other degradation effects after large numbers of prints are made.

BACKGROUND OF THE INVENTION

In electrophotographic (EP) printers, such as a laser printer, a photoconductive drum is typically used as the source object from which the image is initially formed by dots of laser light impacting the surface of this drum. The photoconductive drum is typically charged to a substantial voltage, such as a voltage greater than 1,000 VDC. This voltage could be either positive or negative with respect to ground, depending upon the charging system and the chemicals used in the photoconductive drum material. Additionally, an AC voltage superimposed on the DC voltage could be used.

For this photoconductive drum to achieve this substantially large voltage, it is typical for a charge roller to be placed into contact with the surface of the photoconductive drum. The charge roller typically comprises a moderately electrically conductive cylinder, or a semiconductive cylinder, which has an electrically conductive center that receives a high voltage from a high voltage power supply. As voltage is received at the electrically conductive center, this voltage charges the entire charge roller, including its outer cylindrical surface. This high voltage at the cylindrical surface of the charge roller is then passed onto the outer surface of the photoconductive drum as the drum rotates.

In laser printers manufactured by Lexmark International Inc., the charge roller is mounted in the printer, and the photoconductive drum is mounted in a removable and replaceable process cartridge. A felt wiper is provided to clean contamination from the surface of the charge roller, and is renewed with every new process cartridge replacement. The life of a process cartridge is a maximum of approximately 25,000 prints, whereas the life of the charge roller is a minimum of 250,000 prints. It is recommended to replace the charge roller itself at scheduled maintenance intervals of 250,000 prints, since the charging characteristics of the charge roller change over time.

The ability of the charge roller to charge the photoconductive drum decreases over its life due to roller characteristics and contamination of the surface of the roller. This decrease in voltage could, over time, impact the ability of the photoconductive drum to produce accurate prints. Consequently, it would be an improvement to be able to compensate for the changing characteristics of the charge roller over its life span.

SUMMARY OF THE INVENTION

Accordingly, it is a primary advantage of the present invention to compensate for variations in the charge roller voltage characteristics over the life of the charge roller of an electrophotographic printer. It is another advantage of the present invention to automatically adjust the high voltage applied to the charge roller that is on the "machine side" of an electrophotographic printer over its life in order to automatically compensate for its changing characteristics, in which the photoconductive drum is mounted in a replaceable process cartridge in order to maintain a relatively narrow band of charging voltage at the photoconductive drum.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved electrophotographic printer is provided in which the charge roller is constructed on the "machine side" of the printer, while the photoconductive drum is constructed on the "process cartridge side" of the printer, and in which the voltage applied to the charge roller is automatically adjusted to compensate for its changing characteristics over its life span. In a preferred laser printer of the present invention, a high voltage DC power supply includes an output that is connected to the charge roller, and the input side of this high voltage DC power supply is controlled by a microprocessor of the print engine. The input to the high voltage power supply is a pulse-width modulated control signal, and the greater its duty cycle, the greater the output voltage magnitude of the high voltage DC power supply. The preferred laser printer has a detachable and replaceable process cartridge, and this process cartridge includes a photoconductive drum that is replaced at the same time a new toner supply is provided. However, this preferred laser printer does not replace the charge roller with the process cartridge, since the charge roller is on the "machine side" of the printer.

When the charge roller is new, its effective charging voltage to which it charges the photoconductive drum is at its greatest magnitude. As the printer is used, the effective charging voltage begins to drop, both due to the charge roller characteristics and to contamination on the surface of the roller. Without compensation, the charge roller effective voltage continues to drop throughout the operating life span of the charge roller. These characteristics can be measured and are quite repeatable over the number of prints made for a particular charge roller. The print engine can control the output voltage of the high voltage DC power supply merely by changing the duty cycle of the pulse-width modulated control signal that is supplied to the input of the high voltage DC power supply.

In the present invention, a "maintenance count" is stored in a non-volatile memory of the printer, and this maintenance count is incremented every time a new print is made. A look-up table is provided that will be inspected by the processor of the print engine, and this look-up table contains the correct duty cycle for the pulse-width modulated control signal with respect to the number of prints that have been made according to the maintenance count. The result of the inspection of the look-up table is used by the microprocessor of the print engine to control the correct duty cycle for the pulse-width modulated signal. Since the charge roller is at its maximum capability when it is brand new, the output voltage initially is not driven to its maximum value by controlling the duty cycle of the pulse-width modulated control signal to be much less than 100%. Over time (i.e., over the number of prints made according to the maintenance count), the charge roller characteristics begin to change, and after a predetermined number of prints have been made, the pulse-width modulated control signal has its duty cycle increased by a value that is provided in the look-up table. This increase in the duty cycle is performed several times over the operating life of the charge roller, in order to maintain the effective voltage applied to the photoconductive drum to a nominal value.

By an intelligent selection of duty cycle values in the look-up table, the combination of the charge roller characteristics and the actual voltage provided by the high voltage DC power supply that is supplied to the charge roller, a relatively constant photoconductive drum voltage will be maintained throughout the life of the charge roller (e.g., up to its maintenance cycle at every 250,000 prints). Much of the hardware to implement the present invention can be provided in a single ASIC (Application Specific Integrated Circuit), potentially including the microprocessor of the print engine and the look-up table. Of course, the high voltage DC power supply would have to be implemented in separate electronic components.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
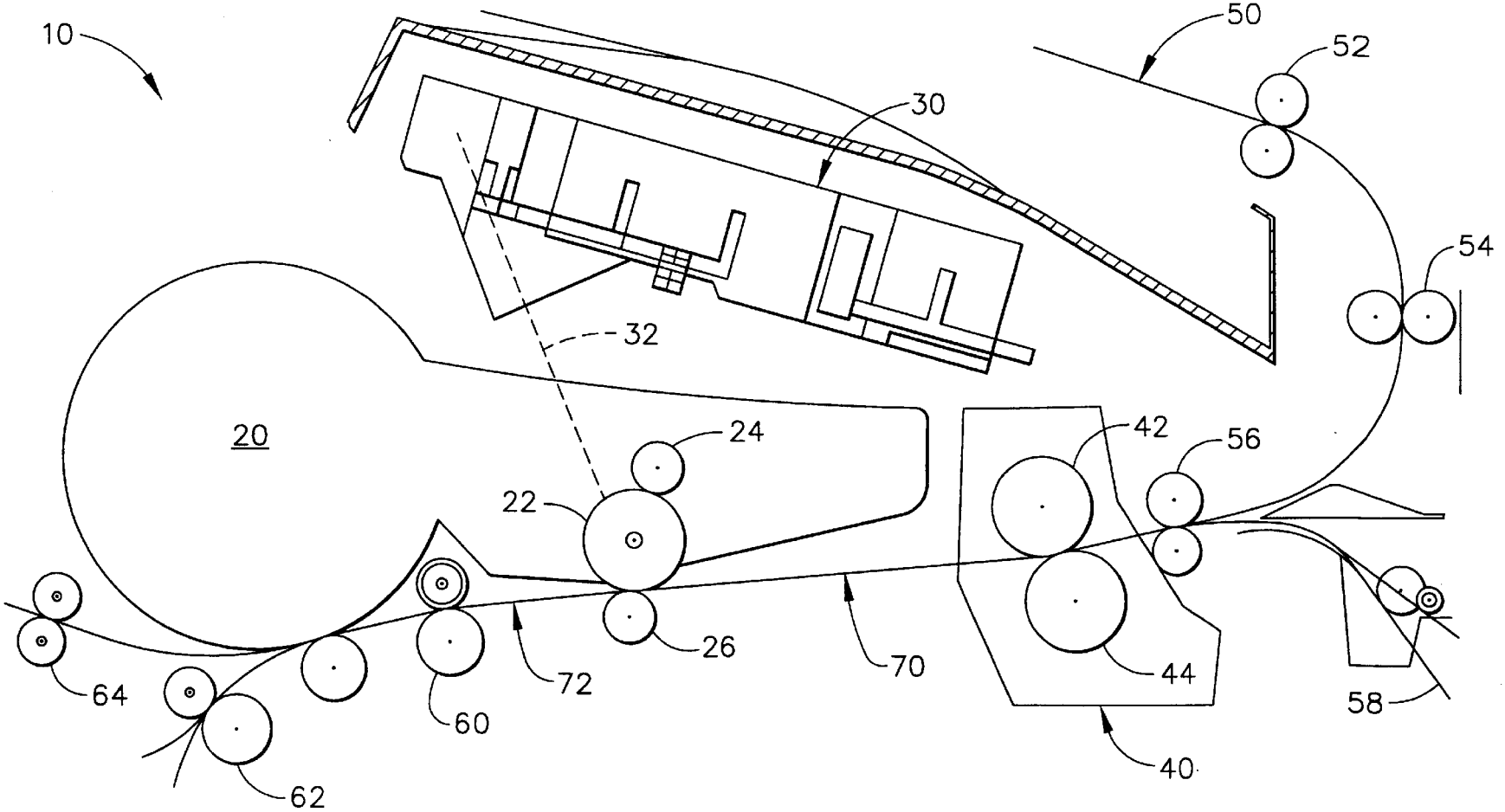
FIG. 1 is a diagrammatic view of some of the major components of the printer of the present invention, visualizing its paper path through the print engine, and including the photoconductive drum and charge roller.

Referring now to the drawings, FIG. 1 shows the major components of a laser printer in diagrammatic view, in which the laser printer is generally designated by the reference numeral 10. A removable and replaceable electrophotographic (EP) process cartridge is provided, generally designated by the reference numeral 20. This process cartridge 20 includes a new toner supply, photoconductive (PC) drum 22, developer roller 80, and a doctor blade 82 (see FIG. 2). The EP process cartridge can contain enough toner for up to 25,000 prints, although smaller sized process cartridges also are available that can only print up to 7,500 prints.

Laser printer 10 also includes a charge roller 24, transfer roller 26, and a laser printhead 30. The preferred charge roller 24 has an operating life time of at least 250,000 prints, and perhaps as many as 300,000 prints. In a preferred laser printer manufactured by Lexmark International Inc., the charge roller is replaced as part of a maintenance kit, which also includes a new fuser 40, transfer roller 26, and certain paper path rollers. The preferred laser printer will provide a message to the user when a "maintenance count" reaches 250,000 (representing 250,000 prints) by displaying a message on the operator panel for the user to see that it is time to have a maintenance kit installed.

Major portions of the paper pathway for the laser printer 10 are also illustrated on FIG. 1, beginning at alternate pathways illustrated at the rollers 64 and 62, which allow paper to be supplied from more than one paper tray or from a manually-fed paper input. As the paper (or other type of print media) approaches the print engine, the pathways merge at a final input roller set 60, and the paper pathway continues at 72 until the paper reaches the photoconductive drum 22 at the print engine stage.

After the paper has had toner applied at the photoconductive drum and transfer roller nip, the paper continues along a pathway 70 to a fuser 40, which includes a hot roller 42 and a backup roller 44. As the paper exits the fuser through rollers 56, the paper pathway can be diverted into several different directions, for example, along a pathway 58, or along a pathway 50 through rollers 54 and 52.

Figure 2:
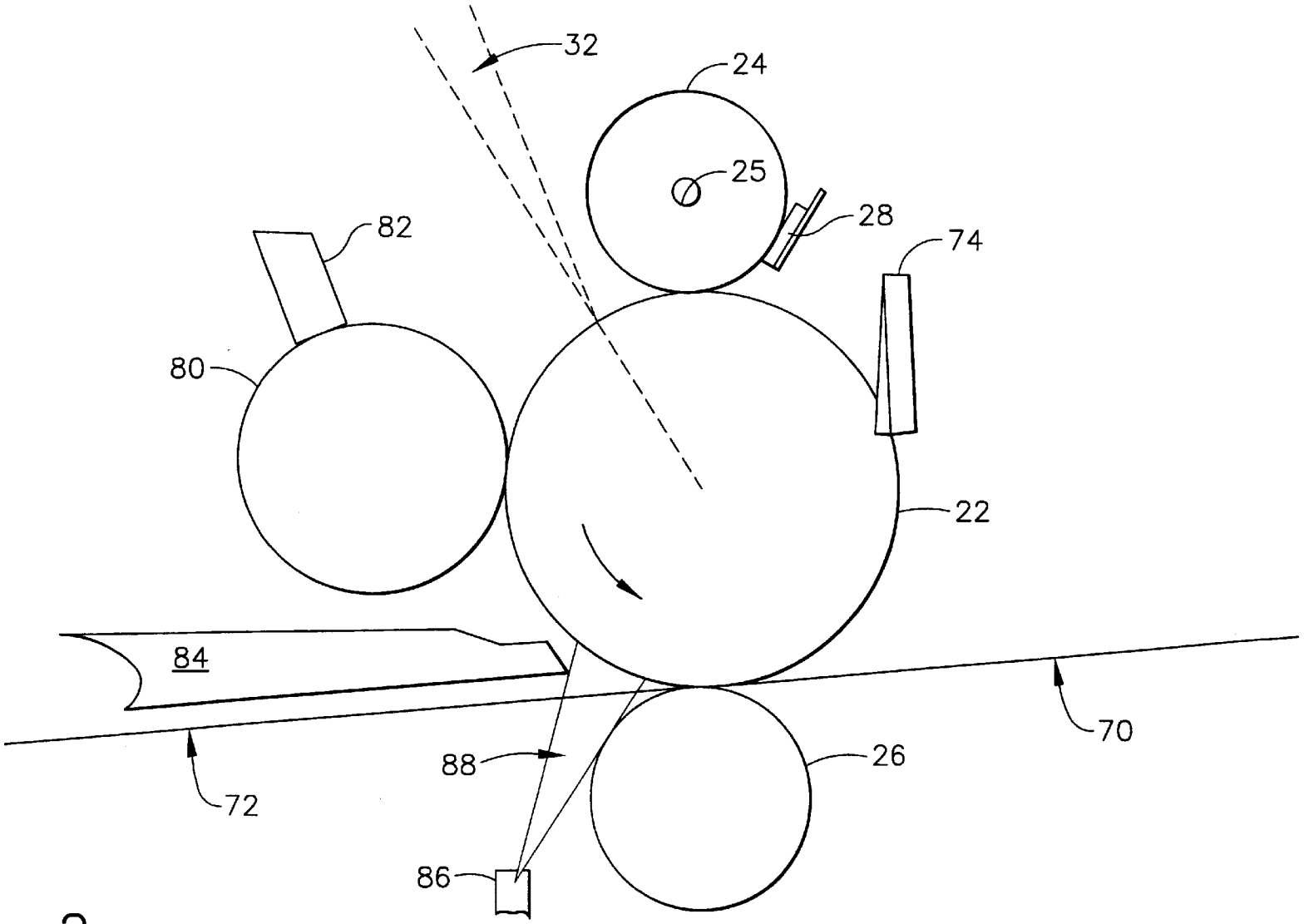
FIG. 2 is a cross-sectional view of the details of the layout of the photoconductive drum and charge roller portions of the print engine of FIG. 1.

Referring now to FIG. 2, the details of the print engine portions that directly affect the photoconductive drum are illustrated. The input paper pathway is depicted at 72, and the output paper pathway is depicted at 70. The laser light pathway is illustrated by the dashed lines 32, and this pathway of course emanates from the laser printhead 30. (See FIG. 1).

The charge roller 24 makes direct contact with the cylindrical surface of the PC drum 22. A felt wiper, depicted at the reference numeral 28, preferably is supplied as an attempt to keep the charge roller 24 free from contamination. In the preferred Lexmark laser printer, the felt wiper 28 is replaced with every new EP process cartridge 20.

Toner material is supplied using the developer roller 80, which has an associated doctor blade 82 to maintain a uniform quantity of toner material across the width of the developer roller. As the toner material makes contact with the PC drum 22, the portions of that toner that are to be applied to the paper will electrostatically attach themselves to the surface of the PC drum 22 until the particular portion of the PC drum reaches the paper, at which time the toner is applied to the paper at the nip between the PC drum 22 and the transfer roller 26. A cleaner blade 74 is provided to clean off any excess residue of toner from the surface of the PC drum 22.

The bottom of the developer section is illustrated at the reference numeral 84, and this directs the light from an erase head 86. The erase light pathway is illustrated at 88, and flows through the opening between the edge of the developer bottom 84 and the transfer roller 26.

The typical charge roller, as described in U.S. Pat. No. 5,637,391, is made of HYDRIN rubber, which is manufactured by B.F. Goodrich Company. The outer cylindrical surface of the HYDRIN rubber is preferably coated with a toner-type resin known as ACRYBASE 1406, which is manufactured by Fujikura Kasei Company, Limited of Tokyo, Japan. It is preferred that 10 micron particle size be used for this coating, and that the coating be baked onto the outer surfaces of the charge roller. The cylindrical HYDRIN portion of the charge roller is mounted on a steel shaft 25, which is electrically conductive and which acts as a high voltage electrode that is attached to an electrical wire that is run back to the output of a high voltage DC power supply.

It should be noted at this point that the charge roller voltage can be modified for certain types of environmental conditions, and this has been available in prior printers. This is accomplished by driving 8 microamps, for example, through the transfer roller 26 and into the PC drum 22, before printing starts. The voltage to the transfer roller 26 is then measured, and if this voltage is greater than a first threshold, a conclusion is made that the air is relatively dry. Therefore, the charge roller voltage is increased by either 36 VDC or 72 VDC. (It turns out that each increment or decrement of the duty cycle that controls the output voltage of the preferred high voltage DC power supply that directly feeds the charge roller allows for 36 VDC increments or decrements.) On the other hand, if the voltage measurement at the transfer roller is below a second threshold, then the conclusion is made that the air is humid, and the charge roller voltage is decreased by 36 VDC. In the preferred Lexmark laser printer, the transfer roller voltage is controllable in 256 steps, from a voltage magnitude of +4600 VDC maximum to −1350 VDC minimum.

Figure 5:
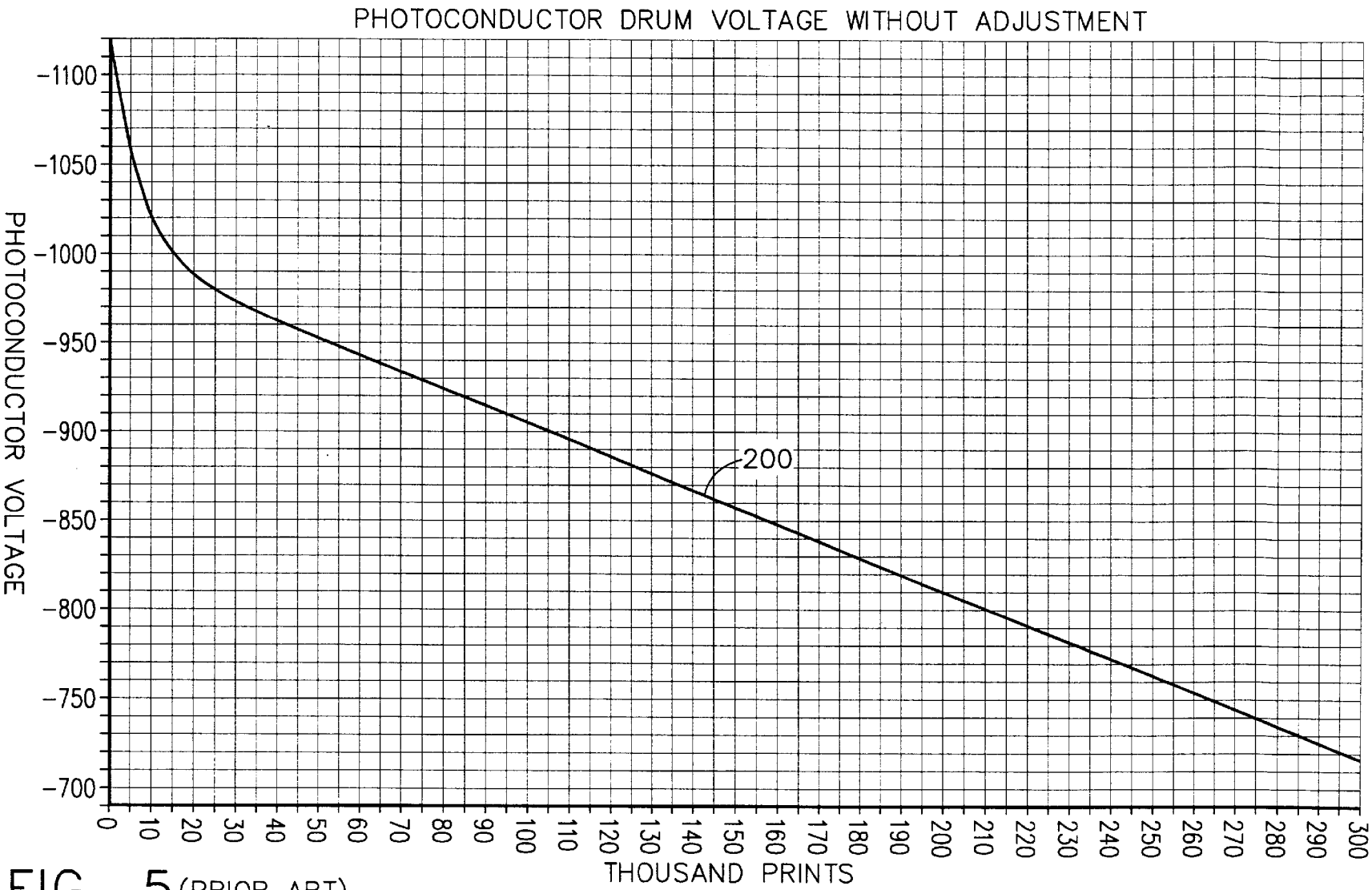
FIG. 5 (PRIOR ART)
FIG. 5 is a graph of the photoconductive drum voltage without adjustment, as is known in the prior art.

As related above, it is known that the PC drum voltage will fall over time if the voltage applied to the charge roller remains constant throughout its life span. FIG. 5 provides graphical information concerning a prior art PC drum voltage versus the number of prints made using a single charge roller. As can be seen from FIG. 5, the photoconductor voltage begins at a maximum of around 1120 VDC, but quickly drops by around 100 VDC after only 10,000 prints have been made. The slope of the voltage drop-off finally begins to lessen and become approximately a constant negative slope after 30,000 prints have been made using a single charge roller. It will be understood that the photoconductive drum itself has been changed at least once before this 30,000 print figure has been reached. Moreover, it will be also understood that the photoconductive drum will be changed at least ten times during the life span of the charge roller, including the data shown on the graph of FIG. 5 at curve 200. It is easy to see that installing a new photoconductive drum does not correct the situation with respect to its effective voltage falling due to a charge roller becoming aged with time and use.

Figure 3:
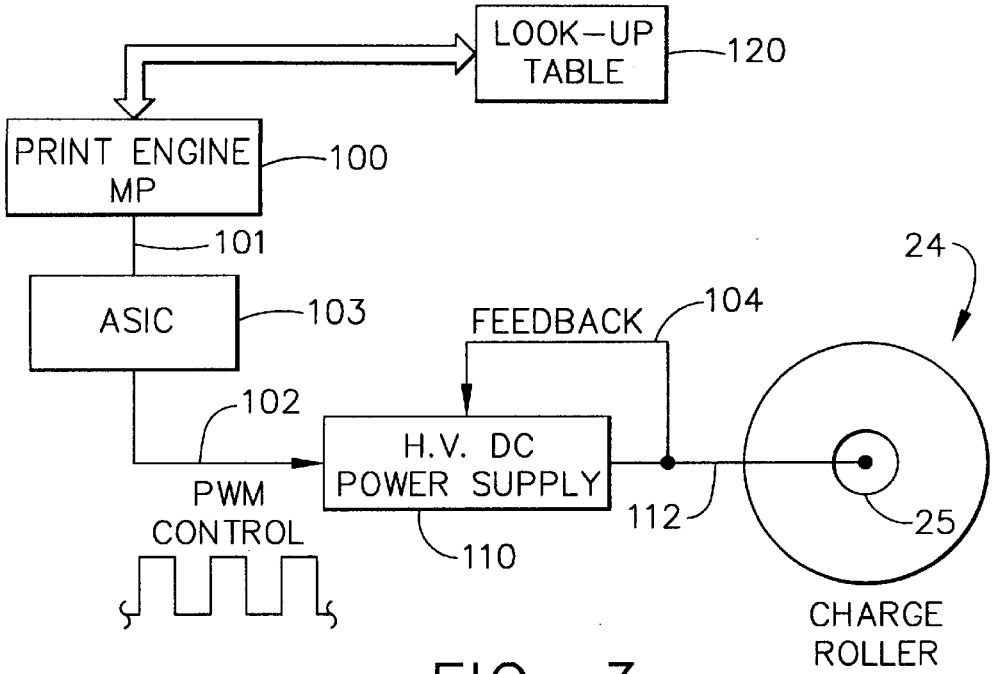
FIG. 3 is a block diagram of the major electrical components used to implement the present invention, along with the print engine of FIG. 1.

On FIG. 3, the microprocessor of the print engine is depicted at the reference numeral 100. Using an output digital signal at 101, the microprocessor 100 can control the effective output voltage of a high voltage DC power supply 110. DC power supply 110 preferably comprises a chopper-stabilized negative feedback high voltage power supply, in which its input control voltage is a low level signal (at TTL or CMOS signal levels) in the form of a duty cycle, which effectively represents a pulse-width modulated control signal at 102. This pulse width modulated signal is generated by an ASIC 103, using the digital output signal 101 from microprocessor 100.

The DC power supply 110 also provides a feedback signal at 104 to a feedback control input of the power supply itself. The output at 112 of the high voltage power supply 110 is connected to the steel shaft 25 of the charge roller 24. In this manner, the voltage applied at the shaft 25 will then charge the entire roller, including its cylindrical surface.

A look-up table 120 is also provided as stored values in a non-volatile memory which the print engine microprocessor 100 accesses at appropriate times. The values in this look-up table are used to determine the duty cycle of the pulse-width modulated control signal 102. The print engine microprocessor inspects a particular memory location in look-up table 120, depending upon how many prints have been made since the last maintenance operation on the printer 10.

Figure 4:
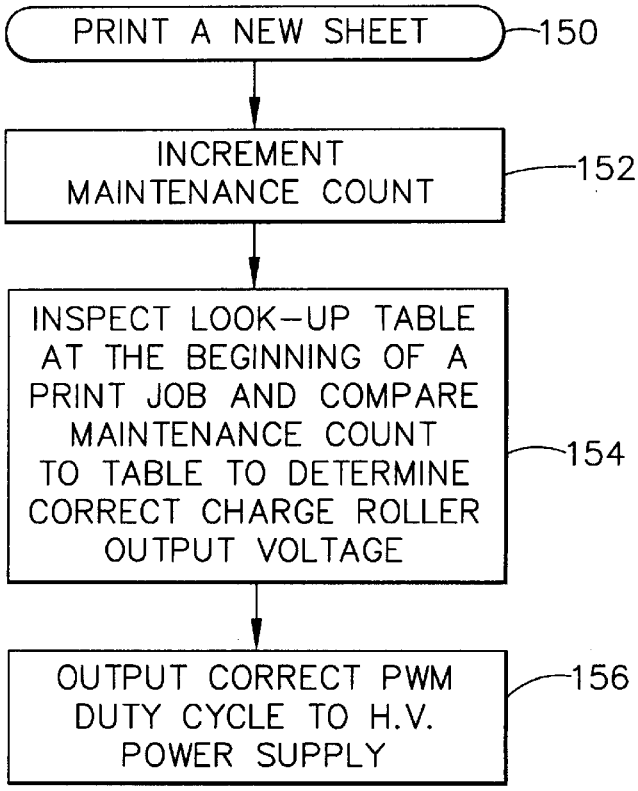
FIG. 4 is a flow chart describing the logical operations required to implement the principles of the present invention using the print engine hardware of FIGS. 1 and 3.

FIG. 4 is a flow chart showing the important logical operations used in controlling the charge roller voltage of the present invention. Starting at a step 150, every time a new sheet is printed this routine is entered. At a step 152, the maintenance count is incremented due to the printing of this sheet of print media (e.g., paper). At a step 154, at the beginning of a print job the look-up table 120 is inspected and the maintenance count value is compared to values in the look-up table to determine what the correct charge roller output voltage should be.

In the preferred embodiment of the present invention, the look-up table provides numeric values of the duty cycle, in which the maximum duty cycle of 100% is equal to $^{64}/_{64}$, so that each duty cycle increment is equal to $^{1}/_{64}{}^{th}$ of the full 100% of the cycle. In this illustrated embodiment, the full regulated range of the output voltage at 112 of the high voltage DC power supply 110 has a "maximum" value of −1846 VDC, which is equivalent to $^{64}/_{64}$ parts of the duty cycle. Each $^{1}/_{64}{}^{th}$ duty cycle reduction will reduce the absolute magnitude of this voltage by 36 VDC, which means that a duty cycle of $^{63}/_{64}$ would be equivalent to a charge roller voltage of −1810 VDC.

Once the maintenance count has been matched up to one of the values in the look-up table 120, the appropriate duty cycle value is determined and the print engine instructs ASIC 103 at a step 156 to output the correct pulse-width modulated duty cycle at signal 102 for the input to the high voltage DC power supply 104. In this manner, the print engine microprocessor 100 can directly control the magnitude of the output voltage of high voltage DC power supply 110. Of course, it is this output voltage at 112 that is desired to be controlled with respect to optimizing the charge roller voltage applied to the PC drum 22.

As discussed hereinabove, without adjustment the PC drum voltage starts at a maximum and will rather quickly decrease in magnitude by approximately 100 VDC after 10,000 prints have been made using a particular charge roller. The effective PC drum voltage will continue to decrease, as according to the graph 200 on FIG. 5. To compensate for this physical characteristic of the laser printing system of the present invention, the output voltage at 112 that is applied to the charge roller 24 will be controlled so as to gradually raise the charge roller voltage that is applied to the PC drum's surface.

Figure 6:
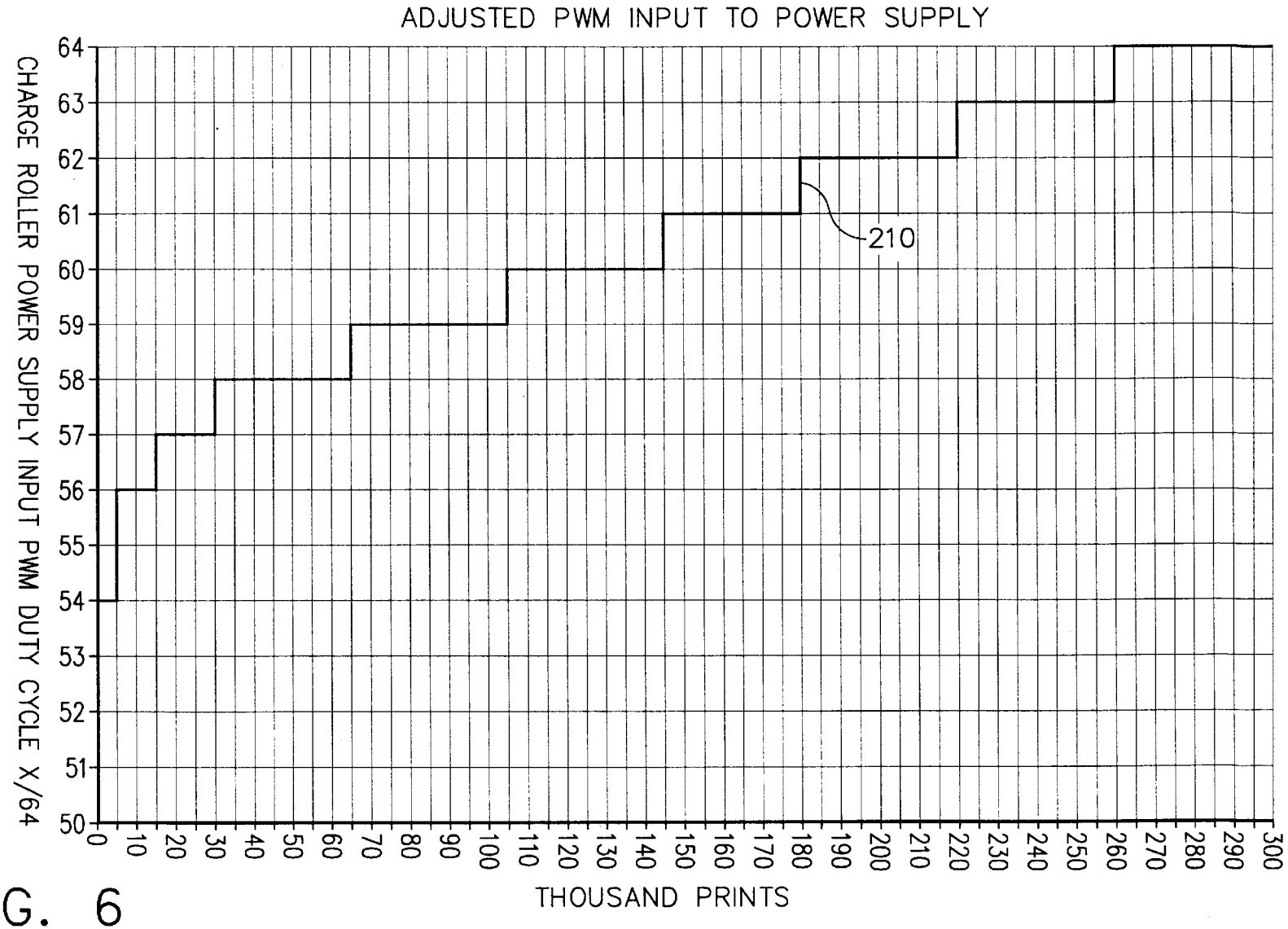
FIG. 6 is a graph of the adjusted pulse-width modulated input duty cycle to the high voltage power supply of FIG. 3, as according to the present invention.

A graph 210 on FIG. 6 illustrates a preferred pulse-width modulated duty cycle in parts per 64 increments of the duty cycle value. On the Y-axis, the charge roller power supply input voltage is given in parts per $^{1}/_{64}{}^{th}$ of the duty cycle, starting at a minimum of 54/64 parts of the duty cycle. This represents a duty cycle of approximately 84%. The pulse-width modulated duty cycle value preferably increases as the number of prints are made on a particular charge roller, as according to the graph 210. The charge roller voltage will be increased accordingly, in proportion to the duty cycle changes at the input of the high voltage power supply. The maximum possible voltage will be achieved when the duty cycle equals 100%, which is equivalent to 64/64 parts of the duty cycle, which is arrived at after 260,000 prints have been made. By this time, the charge roller and other components should have been changed by having a new maintenance kit installed in the laser printer. Once the maintenance kit is installed, the "maintenance count" is reset to zero (0), and the charge roller voltage is set back to its initial value using a 54/64 duty cycle.

Figure 7:
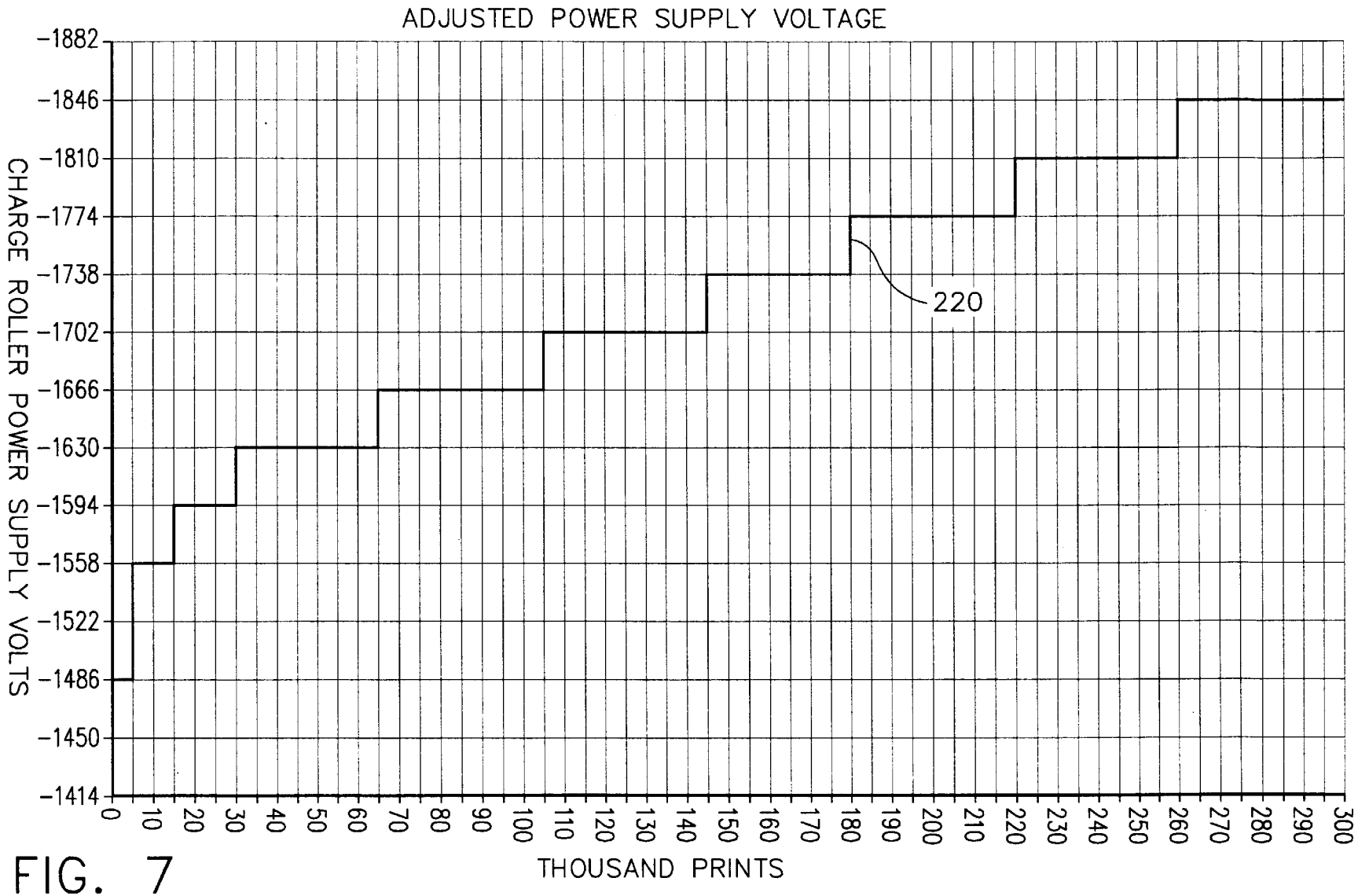
FIG. 7 is a graph of the adjusted output voltage of the high voltage power supply of FIG. 3, as according to the present invention.

FIG. 7 illustrates a graph 220 which indicates the charge roller power supply voltage that is output at 112 from the high voltage DC power supply 110. This is the voltage that is directly applied to the steel shaft 25 of the charge roller 24. As would be expected, this output voltage changes in proportion to the duty cycle input of the pulse-width modulated input signal 102 to the high voltage DC power supply. The maximum output voltage of −1846 Volts (i.e., the absolute value of this voltage) is achieved after 260,000 prints have been made on a particular charge roller. Again, this should never occur if the printer is properly maintained, because a new maintenance kit should be installed after 250,000 prints.

Figure 8:
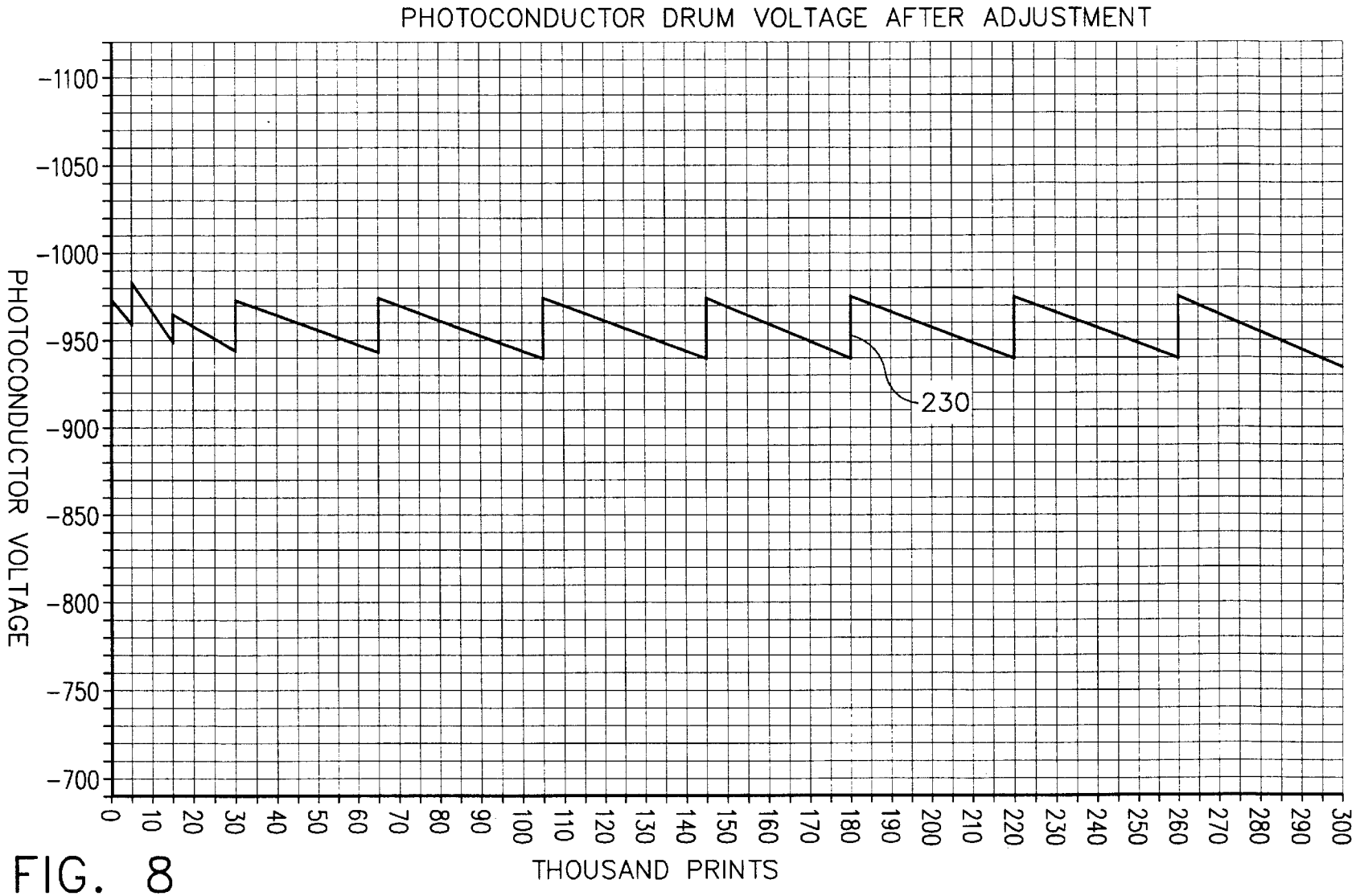
FIG. 8 is the photoconductive drum voltage when using the principles of the present invention, using the hardware of FIG. 3.

The overall effect of adjusting the power supply voltage to the charge roller is illustrated on FIG. 8. The graph 230 on FIG. 8 shows the photoconductive drum effective voltage versus the number of prints that have been produced using a particular charge roller. This voltage value begins at around 975 VDC magnitude, and tends to zig-zag up and down along the Y-axis according to the number of prints that have been produced. After the value of the voltage falls for awhile, it is stepped back up due to an increase in the output voltage 112 that is applied to the charge roller 24. The main object here is to attempt to keep the effective photoconductive drum voltage as near a constant value as is possible, and this is achieved within a range of about 40 Volts as compared to an overall magnitude of about 960 VDC. This is a tolerance of only about 5%, which should lead to a very uniform performance of the photoconductive drum for the preferred laser printer. By preventing the effective photoconductive drum voltage from decreasing by the very large voltage drop experienced in PC drums that have no adjustment, the previously-known poor performance can be avoided in which a photoconductive drum having an effective low voltage can leave impressions of the previous sheet on the next sheet to be printed.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A method for compensating voltage degradation over time of a photoconductive element in an image forming apparatus, said method comprising:

(a) providing a photoconductive element, a charging element, a DC power supply, and a controller that outputs a signal to control an output voltage of said DC power supply;

(b) at a time when said charging element of said image forming apparatus is substantially new, and until said image forming apparatus has created a first predetermined number of output images, controlling said signal to cause said DC power supply to output a first output voltage magnitude, which in turn charges a surface of said charging element, which in turn charges a surface of said photoconductive element to a first PC voltage magnitude, and maintaining said first output voltage magnitude even though the voltage at said surface of said photoconductive element may decrease in absolute value over time;

(c) after said image forming apparatus has created a first predetermined number of output images and until said image forming apparatus has created a second predetermined number of output images, controlling said signal to cause said DC power supply to output a second output voltage magnitude that is greater in absolute value than said first output voltage magnitude, thereby raising in absolute value the surface voltage of said charging element, and thereby raising in absolute value the surface voltage of said photoconductive element to approximately said first PC voltage magnitude, and maintaining said second output voltage magnitude even though the voltage at said surface of said photoconductive element may decrease in absolute value over time; and (d) after said image forming apparatus has created a second predetermined number of output images and until said image forming apparatus has created a third predetermined number of output images, controlling said signal to cause said DC power supply to output a third output voltage magnitude that is greater in absolute value than said second output voltage magnitude, thereby raising in absolute value the surface voltage of said charging element, and thereby raising in absolute value the surface voltage of said photoconductive element to approximately said first PC voltage magnitude, and maintaining said third output voltage magnitude even though the voltage at said surface of said photoconductive element may decrease in absolute value over time.

2. The method as recited in claim 1, wherein said image forming apparatus comprises a laser printer, said photoconductive element comprises a photoconductive drum, and said charging element comprises a charge roller.

3. The method as recited in claim 2, wherein said charge roller is charged at an electrically conductive center shaft by making contact with the output voltage of said DC power supply, which thereby charges a moderately electrically conductive cylindrically-shaped material, and wherein said photoconductive drum is charged at a cylindrical surface by making contact with a cylindrical surface of said charge roller.

4. The method as recited in claim 1, wherein said controller comprises a processing circuit that inspects a register to determine the number of output images that have been created, and inspects a look-up table to find a value that corresponds to said number of output images that have been created and uses this value to determine an appropriate value for said signal, and said signal comprises a pulse-width modulated logic level signal that exhibits a duty cycle that is related to the output voltage of said DC power supply, and said DC power supply comprises a chopper-stabilized negative feedback high-voltage power supply that produces a negative DC voltage magnitude.

5. The method as recited in claim 1, further comprising additional voltage-increasing operations similar to step (d), until a number of output images has been created by said image forming apparatus that is substantially equal to the expected life of said charging element.

6. The method as recited in claim 1, wherein said first predetermined number of output images is equal to 5,000, said second predetermined number of output images is equal to 15,000, said third predetermined number of output images is equal to 30,000, and further predetermined numbers of output images that cause additional voltage-increasing operations are equal to 65,000, 105,000, 145,000, 180,000, 220,000, and 260,000, and said expected life of said charging element is equal to 250,000 output images.

7. The method as recited in claim 6, wherein said first output voltage magnitude is substantially equal to −1486 volts DC, said second output voltage magnitude is substantially equal to −1558 volts DC, said third output voltage magnitude is substantially equal to −1594 volts DC, and further DC power supply output voltages after additional voltage-increasing operations are substantially equal to −1630 volts DC, −1666 volts DC, −1702 volts DC, −1738 volts DC, −1774 volts DC, −1810 volts DC, and −1846 volts DC.

8. The method as recited in claim 7, wherein said first PC voltage magnitude is substantially equal to −975 volts DC.

9. The method as recited in claim 6, further comprising displaying a scheduled maintenance message after 250,000 output images, at which time said charging element should be replaced within said image forming apparatus.

10. An image forming apparatus, comprising:

(a) a photoconductive drum, having a substantially cylindrical surface;

(b) a charge roller, having a substantially cylindrical surface which is in electrical contact with the surface of said photoconductive drum;

(c) a DC power supply, having an output voltage that is applied to said charge roller; and (d) a controller that outputs a signal to control the output voltage of said DC power supply; wherein:

(i) at a time when said charge roller is substantially new, and until said image forming apparatus has created a first predetermined number of output images, said controller outputs said signal to cause said DC power supply to output a first output voltage magnitude, which in turn charges a surface of said charge roller, which in turn charges a surface of said photoconductive element to a first PC voltage magnitude;

(ii) after said image forming apparatus has created a first predetermined number of output images and until said image forming apparatus has created a second predetermined number of output images, said controller outputs said signal to cause said DC power supply to output a second output voltage magnitude that is greater in absolute value than said first output voltage magnitude, thereby raising in absolute value the surface voltage of said charge roller, and thereby raising in absolute value the surface voltage of said photoconductive element to approximately said first PC voltage magnitude; and (iii) after said image forming apparatus has created a second predetermined number of output images and until said image forming apparatus has created a third predetermined number of output images, said controller outputs said signal to cause said DC power supply to output a third output voltage magnitude that is greater in absolute value than said second output voltage magnitude, thereby raising in absolute value the surface voltage of said charge roller, and thereby raising in absolute value the surface voltage of said photoconductive element to approximately said first PC voltage magnitude.

11. The image forming apparatus as recited in claim 10, wherein said photoconductive drum is part of a replaceable process cartridge, and said charge roller is part of the machine side of said image forming apparatus, and is replaced only as part of a maintenance kit.

12. The image forming apparatus as recited in claim 10, wherein said charge roller comprises a moderately electrically conductive main body of HYDRIN rubber, coated with ACRYBASE resin, and a central shaft made of steel; and wherein the output voltage of said DC power supply is electrically connected to said central shaft.

13. The image forming apparatus as recited in claim 10, wherein said controller comprises a processing circuit that inspects a register to determine the number of output images that have been created, and inspects a look-up table to find a value that corresponds to said number of output images that have been created and uses this value to determine an appropriate value for said signal, and said signal comprises a pulse-width modulated logic level signal that exhibits a duty cycle that is related to the output voltage of said DC power supply, and said DC power supply comprises a chopper-stabilized negative feedback high-voltage power supply that produces a negative DC voltage magnitude.

14. The image forming apparatus as recited in claim 10, wherein said first predetermined number of output images is equal to 5,000, said second predetermined number of output images is equal to 15,000, said third predetermined number of output images is equal to 30,000, and further predetermined numbers of output images that cause additional voltage-increasing operations are equal to 65,000, 105,000, 145,000, 180,000, 220,000, and 260,000, and said expected life of said charge roller is equal to 250,000 output images.

15. The image forming apparatus as recited in claim 14, wherein said first output voltage magnitude is substantially equal to −1486 volts DC, said second output voltage magnitude is substantially equal to −1558 volts DC, said third output voltage magnitude is substantially equal to −1594 volts DC, and further DC power supply output voltages after additional voltage-increasing operations are substantially equal to −1630 volts DC, −1666 volts DC, −1702 volts DC, −1738 volts DC, −1774 volts DC, −1810 volts DC, and −1846 volts DC.

16. The image forming apparatus as recited in claim 15, wherein said first PC voltage magnitude is substantially equal to −975 volts DC.

17. The image forming apparatus as recited in claim 14, further comprising displaying a scheduled maintenance message after 250,000 output images, at which time said charge roller should be replaced within said image forming apparatus.

18. The image forming apparatus as recited in claim 13, wherein said look-up table cross-references said number of output images that have been created to a duty cycle for said signal.

19. The image forming apparatus as recited in claim 18, wherein said duty cycle for said signal is in units of 1/64ths.

* * * * *